US005398585A

United States Patent [19]

Starr

[11] Patent Number: 5,398,585

[45] Date of Patent: Mar. 21, 1995

[54] FINGERBOARD FOR MUSICAL INSTRUMENT

[76] Inventor: Harvey Starr, 1717 Fifth Ave., San Diego, Calif. 92111

[21] Appl. No.: 813,996

[22] Filed: Dec. 27, 1991

[51] Int. Cl.[6] ..... G10H 1/00

[52] U.S. Cl. ..... 84/646; 84/665; 84/DIG. 30

[58] Field of Search ..... 84/646, 719, 720, 722, 84/744, 745, DIG. 30, 633, 665, 711, 741, 670

[56] References Cited

U.S. PATENT DOCUMENTS

| | | | |
|---|---|---|---|
| Re. 31,019 | 8/1982 | Evangelista | 84/DIG. 30 |
| 3,555,166 | 1/1971 | Gasser | 84/722 |
| 4,031,800 | 6/1977 | Thompson | 84/423 R |
| 4,336,734 | 5/1983 | Gunn | 84/646 |
| 4,570,521 | 2/1986 | Fox | 84/653 |
| 4,630,520 | 12/1986 | Bonanno | 84/647 |
| 4,748,887 | 6/1988 | Marshall | 84/646 |

*Primary Examiner*—Howard B. Blankenship
*Assistant Examiner*—Cessandra C. Spyrou
*Attorney, Agent, or Firm*—Wagner & Middlebrook

[57] ABSTRACT

An electronic musical instrument is designed in a generally guitar-shaped configuration with a fingerboard containing rows of keys replacing each string, one key for each string/fret position. Pressing on a key causes a signal to be provided to a central processing unit which continually scans the fingerboard at a high rate and converts the signals to a plurality of outputs to a synthesizer. Unlike a guitar, a plurality of keys, including a plurality along a single row, may be operated simultaneously to produce a plurality of notes simultaneously. A number of pressure switches and other switches located on the body enable a player to modify the output with vibrato, pitchbend, stereo pan, percussion effects, etc. Additional pressure responsive circuits provide inputs to the central processing unit varying with pressure on the keys. A second embodiment includes a fingerboard with many more rows or columns of keys and more keys per column. In either embodiment the keys may be colored similarly to a piano keyboard or otherwise either embodiment may have a specified or programmable musical interval between adjoining keys on adjacent rows.

25 Claims, 3 Drawing Sheets

FINGERBOARD FOR MUSICAL INSTRUMENT

BACKGROUND OF THE INVENTION

This invention relates to improvements in electronic musical instruments to be played as an input to a music synthesizer and more particularly to an instrument which may simulate some aspects of operation of a stringed instrument such as a guitar.

In the art of electronic music and musical instruments where many input devices are now essentially digital switching devices and operate in conjunction with a type of standardized digital interface called a MIDI (Musical Instrument Digital Interface) which connects to a music synthesizer. Current synthesizers are extremely versatile; many produce tones similar to several musical instruments. Some can reproduce almost any sound through electronically recorded sampling or create new sounds. Because of the modular nature of the synthesizer voice modules it is not necessary for such input devices themselves to include tone generators or other sound generating means. They only need to produce a digital output which is compatible with the MIDI specification.

There have been many attempts to produce electronic musical instruments which simulate, to greater or less degree, the operation of an acoustic guitar. A number of the patents showing such devices include internal tone generators. One such patent which also substitutes keys on the fingerboard for the strings, but which places a key at each string/fret location, is Gasser Patent 3,555,166. By this is meant that each of the six strings is located over a number of frets, such as 20. An acoustic guitar is played by holding a particular string down against the fingerboard between particular fret positions and picking the string to produce a given note. In the electronic instrument described, a key is placed at each such string/fret position, resulting in six rows or columns of keys, each having 20 keys (or more) in each row, or 120 keys.

Other electronic guitar-like instruments are taught in U.S. Pat. Nos. 4,336,734; 4,570,521; RE 31,019; 4,570,521; and 4,630,520, some of which incorporate strings. Frequently, such instruments incorporate additional switching means placed on the body for various purposes such as making chords, tuning, and expression and modulation information for the synthesizer.

Although some of the prior art patents emphasize various means employed to make such instruments convenient and accessible to one used to playing an acoustic guitar, applicant's experience with at least some of such instruments is that they tend to impose some of their own difficulties and obstacles. At the same time, some such instruments fail to adequately utilize the potential that current technology makes possible for expanding the capabilities of the instrument.

It is, therefore, an object of the present invention to provide an electronic musical instrument offering fretboard technique similar to a stringed guitar but which affords greater flexibility and ease in fingering to produce many additional chords and note combinations and, in particular, makes it possible to play simultaneously, a plurality of notes along a single row of keys (string position).

It is another object of the present invention to provide a musical instrument meeting the above objective while providing a simplified and reliable keyboard structure.

It is another object of the present invention to provide an electronic musical instrument incorporating its own signal processor which is compatible with standard MIDI connection devices to a synthesizer.

It is another object of the present invention to provide an electronic musical instrument in which adjacent rows of keys are musically related by a specific musical interval such as a third or a fourth, which interval is programmable. This type of programmability is extended to each note individually by on-board software which can relate a table of values to each key.

It is a further object of the present invention to provide an electronic musical instrument which meets the above objectives, but which includes a substantially greater number of rows of keys than would be required to represent strings of the usual acoustic guitar.

It is a further object of the present invention to provide an electronic musical instrument which meets the above objectives and allows the active sensing of and responding to any key in a two-dimensional matrix of keys at any time during a musical performance.

It is a still further object of the present invention to provide an electronic musical instrument which meets the above objectives and in which the keys are color coded.

BRIEF DESCRIPTION OF THE INVENTION

The present invention is basically a player actuated switching mechanism for an electronic musical instrument. In its preferred embodiment it includes a fingerboard and a main body with the fingerboard including a set of keys, one for each fret/string position as described. The keys operate flexible rubber push buttons having pads with conductive ink on the bottom which, when pressed, make contact with and bridge across two switching members of a printed circuit, thereby closing the circuit and providing an output signal for each key pressed. Key output signals can be provided from any number of rows and from more than one key in a single row simultaneously.

In one embodiment the keys are arranged in, for example, six rows of twenty, each row having key/fret positions like that of an acoustic guitar. One familiar with playing an acoustic guitar could play such an instrument almost immediately and would soon learn that he had many more combinations of notes that could be played than is possible with an acoustic guitar.

Another embodiment, constructed on the same principles includes many more rows of keys, for example twelve rows, and is fashioned in a fingerboard which is preferably played with the instrument supported on a table and with the player using both hands to operate the fingerboard. The key intervals represent the 12-tone chromatic scale by adjacent keys along a given row, and adjacent keys in adjoining rows are related by a desired interval, such as fourths, the interval being programmable. If the associated synthesizer is capable of producing a number of different types of sounds simultaneously, which most can do, the instrument can be programmed to produce, for example, piano sounds on part of the keyboard, organ-like sounds on another part while simultaneously producing desired percussion sounds. In either of the embodiments discussed above, the keys may be color-coded like the black and white keys of a piano. Other color coding schemes may be used.

The fingerboard has the advantage that in the location of one string (one row of keys) more than one key can be played at a time. This can provide some real advantages in fingering compared to an acoustical guitar where only one note can be played per string at a given time and musical intervals between notes must be played on separate strings. For example, the minor second interval, a space of just one half step on the musical scale, can be played on the piano by striking two adjacent keys. On an acoustic guitar a wide stretch of five frets between two adjacent strings is required for the same result. In the instrument described herein the notes are played by adjacent keys along the same row. This makes close voicing of chords, customary in piano literature, easy to effect on a guitar-like instrument. A corollary benefit allows the playing of two-handed music, such as piano music. Because there are no strings, multiple notes may be heard from a single simulated string (row of keys). A chord or melody line may be played with one hand and a second chord or melody line played with the other at another position along the neck of the instrument.

The printed circuit and fingerboards described above produce a signal processed in a central processing unit as a MIDI code which determines the pitch of a MIDI controllable voice, as in a synthesizer. Another function which may be applied to the fingerboard allows the sensing of varying amounts of finger pressure which information may be used to affect various dynamic parameters of the music such as volume, pitchbend, vibrato, various filter sweep functions or note attack, etc.

The means by which the pressure is sensed includes a strip of variable conductive ink printed on, for example, a mylar substrate. This material when compressed will change its volume resistivity. The opposing switch terminals are formed on a printed circuit substrate as a pair of tracks on one side of the substrate. Compressing the layer of variable conductive ink as a result of pressure from the key, results in closing the switch terminals. A small pin may be attached to the underside of the rubber push buttons which passes through a port in the printed circuit described above and which, when the key is operated, moves to put pressure on the layer of variable conductive ink. Preferably, such pins should have an enlarged surface to contact the variable conductive ink, since the diameter of the pin affects the range of resistance values achievable. Alternatively, piezo-film may be used as a sensing membrane.

The musical instrument of the first embodiment also involves the use of a separate keypad assembly on top of the face of the body. This keypad has three main sections.

1. A single row of sixteen keys encircles the perimeter of the keypad. These are used to control the volume, octave shift, tuning and other valuable performance parameters.

2. An array of six large centrally positioned rubber pads to be struck or pressed by a musician to alter certain dynamic characteristics of his musical performance such a pitchbending, vibrato, or stereo pan. Or they may be programmed to trigger musical sounds or percussion sounds. These large rubber pads have conductive ink on the underside which makes contact with a multiplicity of printed circuit conductors to provide variable resistances whose values vary with the pressure applied to them.

3. An array of six long thin rubber pads placed to simulate the section of strings which would normally sit under a player's fingers of the plucking or strumming hand were he playing an acoustic guitar. These serve to individually affect certain musical notes as they are being held, on a string by string (or row by row) basis. These pads may be used to affect volume levels, pitch, frequency spectrum, intervals between adjacent keys in different rows, signal modifier levels and many local and MIDI programmable functions.

BRIEF DESCRIPTION OF THE DRAWINGS

This invention may be more clearly understood from the following detailed description and by reference to the drawing in which.

DESCRIPTION OF THE PREFERRED EMBODIMENTS

Figures 1, 3:
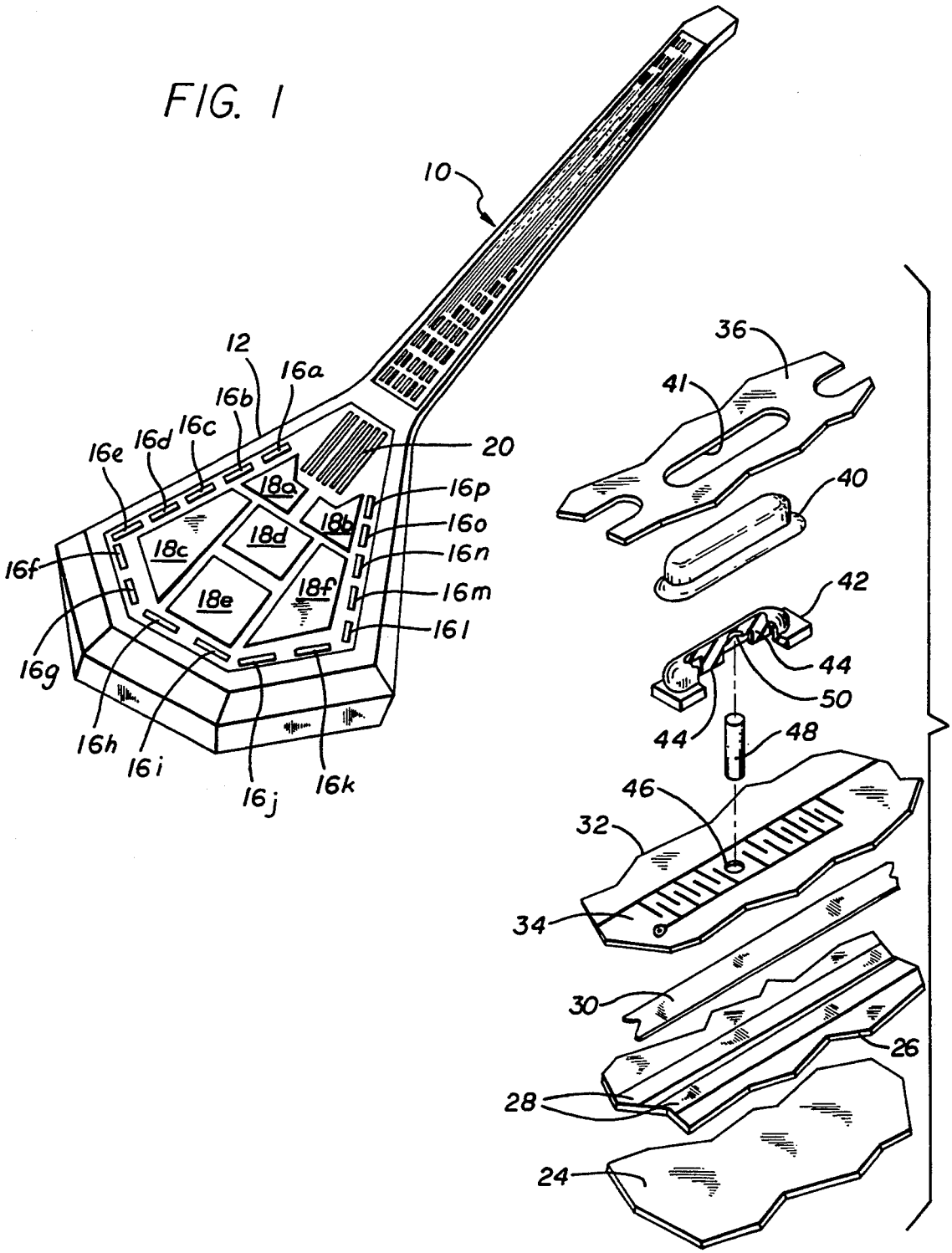
FIG. 1 is a perspective view of a guitar-like musical instrument according to my invention.
FIG. 3 is an exploded view showing details of the fingerboard structure of the device of FIGS. 1 and 2.

Referring now to FIG. 1, the instrument has a guitar-like configuration with an elongated fingerboard 10 attached to a larger body 12. The fingerboard 10 includes six rows of 20 individual keys which are generally arranged similarly to the string/fret arrangement of a conventional guitar. Thus where a guitar has, for example, six strings with 20 finger positions (frets) along each string, the present fingerboard has one key for each finger position along each of six rows of keys spaced essentially like the strings of an acoustic guitar. With this arrangement it is a relatively straightforward matter for one having familiarity with the guitar keyboard to make the adjustment from plucking the string while pressing it at a given location, to pushing a key at the same location. Since the key is operating an electrical switching circuit, very little force is required to push the key and the player will find that playing applicant's instrument is much easier on his fingers as compared with plucking guitar strings.

Located on the periphery of the body 12 are a series of sixteen keys or push buttons 16*a*–16*p*; generally centered on the body 12 are a group of six pressure sensitive drum pads 18*a*–18*f* which may be used to trigger synthesized drum sounds among other functions such as pitchbend, modulation, MIDI after pressure and stereo pan, a group of six elongated switches 20 referred to below as trigger bars which are generally aligned with the rows of keys on the keyboard and which also may be used to trigger synthesized drum sounds. Push buttons 16*a*–16*p* may be used for many functions of which the following are exemplary:

16*a*—discussed below

16*b*—fail safe in case of stuck note. Sends MIDI message "all notes off".

16*c*—varies offsets between adjacent rows of keys, such as:

1) standard guitar tuning for open strings;
2) perfect fourth intervals as in bass guitar;
3) perfect fifth intervals as in the violin family;

4) diminished fifth intervals;
5) augmented fifth intervals ascending by row;
6) open E chord ascending by row.

**16*d*—enables the drum mode which assigns pressure pads 18*a*–18*f*** to various percussion sounds or other sounds within the synthesizer.

**16*e***—sostenuto. Fingerboard keys which are held while the sostenuto button is held, will sustain until this button is depressed again.

**16*f***—volume up-raises the volume of the entire instrument when in single-channel mode or just the selected string/channel when in six-channel mode.

**16*g***—volume down-lower the volume in the same way.

**16*h***—octave up-raises the pitch of the full fingerboard by octaves when in single-channel mode and just the selected string/channel when in six-channel mode.

**16*i***—octave down-lowers the pitch in the same way.

**16*j***—Patch Change Up increments the current Patch selection to the entire fingerboard in single-channel mode and just the selected string/channel in six-string mode.

**16*k***—Patch Change Down decrements the current Patch selection in the same way.

**16*l***—Hold sends the MIDI Hold message to the selected output channel which has the effect of sustaining all notes played thereafter until the Hold button is pressed again.

**16*m***—the Lock button is used to enable/disable the entire Control Panel to prevent undesired effects from accidentally brushing a control key while playing.

**16*n***—Guitar/Poly switches between the six-string Guitar mode which allows only one note per string as in a vibrating string instrument, and the Poly mode in which any key which is pressed will sound regardless of location.

**16*o*—enables or disables the trigger function of the six rubber bars 20**.

**16*p***—this is a 1/6 button which selects the number of MIDI channels on which the instrument may transmit "1" or single-channel mode outputs all notes to the same channel, usually channel #1." "6", or multi-channel mode, outputs the notes from each string of fingerboard keys on separate channels, #1 through #6. In this mode a different instrument's sound may be set up on each string giving the effect of a larger orchestra. Individual channel parameters are programmed by pressing a given string trigger bar while pressing Button #1, Channel Select. Having done this, the parameters adjusted by the Buttons #2, 5–12 and pads #23–28 will affect that channel only. By using these features, six separate instruments may be chosen and mixed to create a properly blended combination played from a single fingerboard.

Each of these switch devices is connected to a central processing unit (CPU) located inside the body (discussed below) and which is designed to provide a MIDI output to a synthesizer. Those skilled in the art will recognize that there are many functions that can be programmed into the CPU. The above description of functions assigned to each switch is exemplary only—many other arrangements could be used.

This fingerboard has four basic modes of operation:

1. Guitar mode—no triggers—this outputs the highest fretted (keyed) notes on each row or "string" by pressing the fingerboard keys only.

2. Guitar Mode—Triggers On. This outputs the highest fretted note on each string by pressing the fingerboard keys and striking one or more of the six trigger bars 20. If a trigger bar is struck when no fingerboard key is held on that string (row) the open string will sound. This is similar to the action of a real guitar string.

3. Poly Mode—No Triggers. This will sound as many keys as are pressed anywhere on the fingerboard at any time, by pressing keys on the fingerboard only.

4. Poly Mode—Triggers On. In this mode all depressed keys are played when their corresponding trigger bars 20 are struck.

Figure 2:
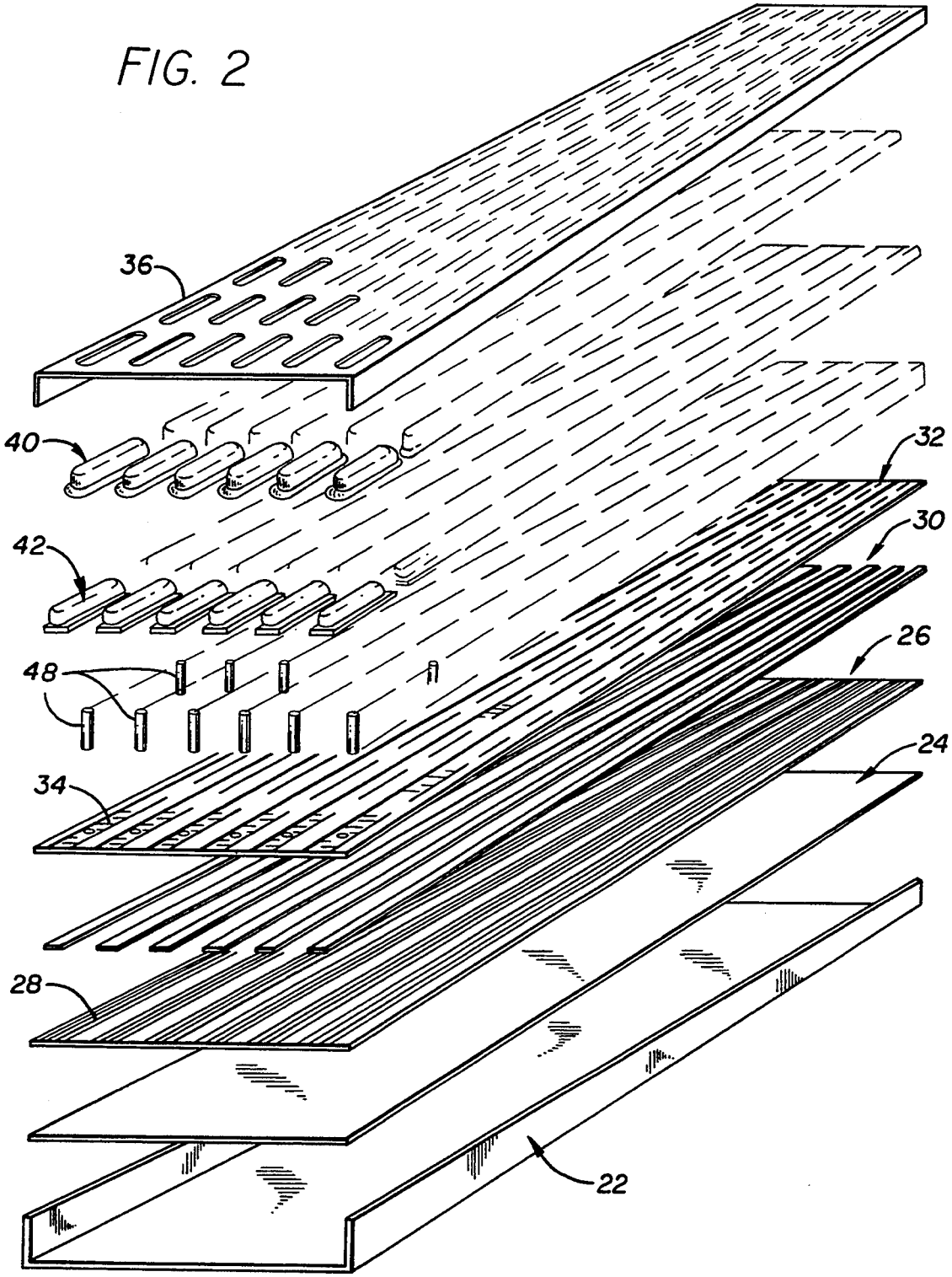
FIG. 2 is a fragmentary exploded view of the fingerboard of FIG. 1.

FIG. 2 is an exploded fragmentary view of the fingerboard assembly formed in the guitar neck. The supporting structure is in the form of an elongated, somewhat tapered channel member 22 having the general dimensions and configuration of a guitar neck. Located at the bottom of the channel member 22 is a resilient backing layer 24 of rubber or synthetic rubber. Immediately above the resilient layer is a printed circuit substrate 26 including a pair of conductor tracks 28 for each row of keys. These tracks constitute opposing switch terminals. Above each pair of tracks is a strip of variable conductive ink printed on a Mylar substrate 30, this arrangement being such that this material, when compressed will change its volume resistivity. Compressing the layer of conductive ink results in closing the switch terminals 28.

The next layer above is a printed circuit board 32 having twenty sets of switch contacts 34 in each of six rows. The printed circuit board is carried in an assembly including a face member 36 carrying six rows of twenty keys. Each key cap 40 presses on a rubber switch member 42 which closes contacts 34 and also presses on an actuator pin 48, discussed below.

In this view it will be observed that there is a pattern of different colored keys. The pattern may be very simple such as changing the color of every key producing an "E" natural. An additional color might be introduced by coloring every "B" natural. There are many patterns which might be used. One extremely useful coloring scheme involves coloring each of the twelve tones of the chromatic scale with a different color. This readily identifies each key name.

FIG. 3 is an exploded perspective view of the internal structure of the fingerboard 10 including the structure of an individual key. Each key cap 40 extends through a port 41 in face member 36 and is a hollow plastic cap covering a rubber switch member 42. On the bottom side of rubber switch member 42 are two conductive pads 44 which, when the key is depressed, move downwardly and bridge across the switch contacts 34 on the printed circuit board 32. This produces a signal which is recognized by the central processing unit as it scans all the key positions on the printed circuit board, which it does at an extremely high rate.

Drilled through the center of each key position on the printed circuit board is a port 46 which receives a rigid actuator pin 48. Actuator pin 48 is seated in a recess 50 in rubber switch member 42 and is moved downwardly when the rubber switch member 42 is depressed, impinging on a Mylar strip 30 which, in turn, is pressed against pressure sensitive circuit board 26 which includes a series of conductive tracks 28 of pressure sensitive resistive material. This layer has resilient backing 24 to enhance the effect of the pressure of pin 48 against tracks 28. The effect of pressing actuator pin 48 against tracks 28 is to vary the resistivity along tracks 28 resulting in an electrical output varying with the pressure on key cap 40. This output may be supplied to the central processing unit to control, for example, the volume of the note produced when the particular key cap 40 is depressed.

From the foregoing it will be recognized that pressing any of the keys 38 on the fingerboard closes a circuit on the printed circuit board 32 which registers as an output from a given key position. This output is recognized as such by the central processing unit and is converted in MIDI form to a signal requesting a particular note from the synthesizer. At the same time the actuator pin 48 is pressed against the tracks 28 and a resistance value is established which results in an output proportional to the pressure on key 38, which output requests a certain volume output. It could vary another variable condition, if desired.

Figure 4:
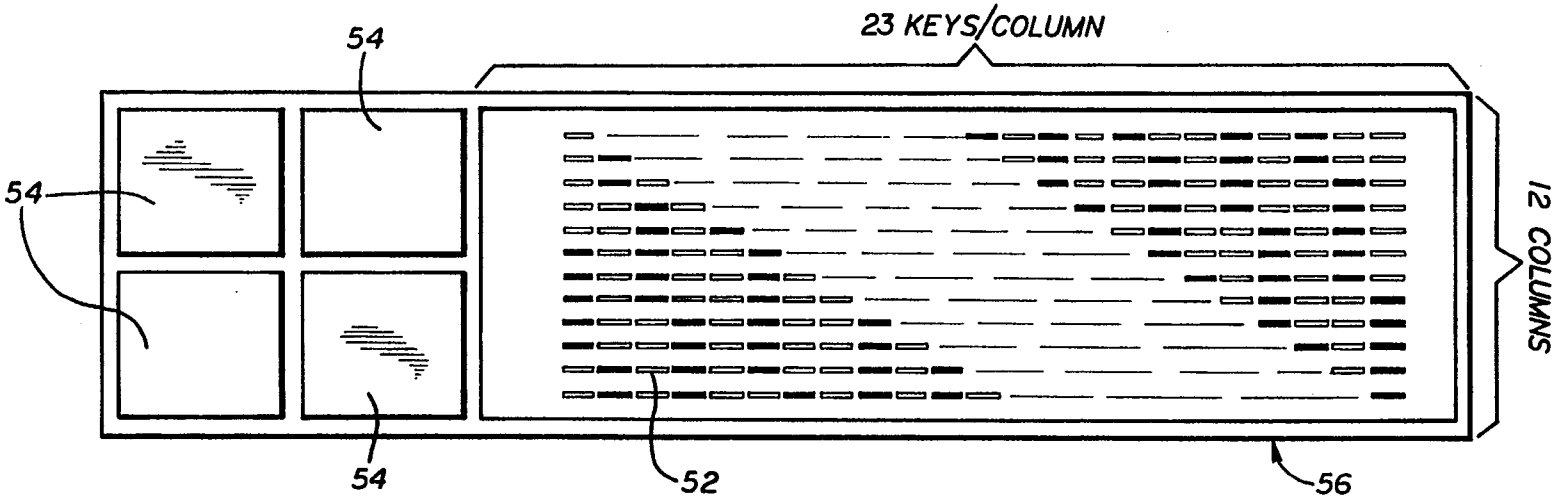
FIG. 4 is a top plan view of another embodiment of my invention.

FIG. 4 is a top plan view of a second embodiment of my invention. This embodiment utilizes much the same organization and structure as described above, but is a larger instrument with the fingerboard arranged in twelve rows of 23 frets (keys). This instrument is played on a table top, much like a conventional electronic keyboard. By adding more strings and frets (columns and rows of keys) the instrument now encompasses six and one half octaves. Many standard guitar finger patterns still apply which, combined with the great range of the instrument, enable a guitar player to play two-handed piano literature.

The fingerboard 52 in addition to having 276 keys arranged in 12 columns or rows of 23 keys each, also incorporates a plurality of pressure sensitive expression pads 54 and software features which, in addition to the variables referred to above such as vibrato, pitchbend, stereo fade, etc., also includes means to re-map the fingerboard 52 into a plurality of zones for special effects and multiple sounds. The base octave of each zone may be set independently. Thus a part of the fingerboard may be programmed to produce guitar-like sounds and another part programmed to produce piano-like sounds. Many combinations become possible. Fingerboard 52 is mounted in a shallow box or housing 56 which contains the key and circuit structure described in connection with FIG. 3 and a central processing unit which may be the same as that referred to above. If desired, a synthesizer could also be incorporated into the housing 56.

Figure 5:
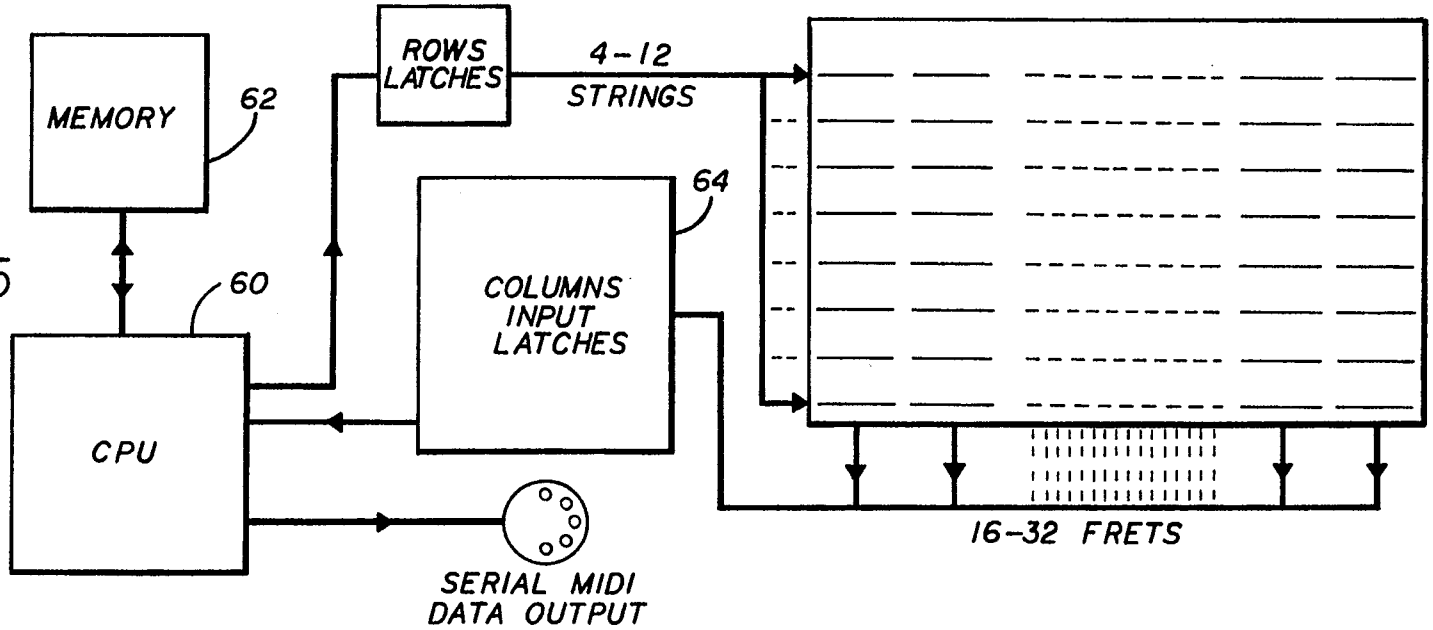
FIG. 5 is a schematic block diagram showing the connections between the fingerboard and the central processing unit and other electronic components.

FIG. 5 is a schematic block diagram of the electrical interface system in applicant's musical instrument for providing a MIDI output to a synthesizer. As indicated above, the output of the fingerboard 10, irrespective of the number of rows or columns, is repeatedly scanned at a high rate by the CPU 60. One or more memory units 62 are connected to the CPU 60 to provide inputs relating to any of several variables such as pitchbend, pitch, vibrato, stereo pan, etc. The memory 62 may also be programmed to tell the CPU 60 to treat certain zones of the fingerboard differently, as where it is desired that one part or zone have piano sounds and another to have guitar sounds.

Outputs from the individual key switches from the fingerboard 10 are sensed on a column by column basis and supplied through a series of input latches 64 to the CPU 60. In the CPU the individual key outputs are modified as called for from the memory unit 62, the data are organized in MIDI form and a digital output in MIDI form is supplied to a synthesizer.

While only two embodiments are shown and described herein it is recognized that many modifications within the scope of the present invention will occur to those skilled in the art. The numbers of keys (frets) per row and the number of rows might be varied although it is obvious that the arrangement described in connection with FIGS. 1 and 2 is advantageous for a guitar player. The pressure sensitive layer 26, Mylar strips and the actuator pins 48 may not always be required and applicant has built one model of the FIG. 4 embodiment without these components. I therefore do not wish to be limited to the embodiments described above but only as established by the following claims as interpreted with the benefit of the doctrine of equivalents.

What is claimed is:

1. For use with a music synthesizer:

an electronic musical keyboard instrument comprising:

a fingerboard elongated in a first direction;

a plurality of keys arranged in rows and columns along said fingerboard, wherein the rows extend along the fingerboard in said first direction;

a circuit board within said fingerboard;

means for mounting each said key movable independently of every other one of said keys and movable into contact with said circuit board;

a central processing unit;

said circuit board including means for forming key input signals in response to said keys contacting said circuit board and for transmitting said signals to said central processing unit;

said central processing unit including means for scanning said circuit board and for receiving said key input signals from said forming and transmitting means, for converting said key input signals to digital signals representing musical notes, and for outputting said digital signals to said synthesizer.

2. An electronic keyboard instrument as claimed in claim 1 wherein said central processing unit includes memory means for storing codes for individual musical notes and includes programmable means for varying said codes.

3. An electronic keyboard instrument in accordance with claim 2 wherein said fingerboard includes pressure responsive means responsive to movement of said keys for forming signals varying with the pressure on said keys and circuit means for connecting said pressure responsive means to said central processing unit.

4. An electronic keyboard instrument in accordance with claim 1 wherein each said key also includes means for varying said key input signals with the pressure applied to move each said key into contact with said circuit board.

5. An electronic keyboard instrument in accordance with claim 4 wherein said varying means further varies said key input signal in amplitude with respect to the pressure applied to each said key.

6. An electronic keyboard instrument in accordance with claim 1 wherein said instrument is generally guitar-shaped, a body is attached to said fingerboard, and said central processing unit is carried in said body.

7. An electronic keyboard instrument in accordance with claim 6 wherein said body includes a plurality of switches connected to said central processing unit for setting performance parameters of said instrument.

8. An electronic keyboard as claimed in claim 1 wherein each said key includes a switch member of elastomeric material having a conductive pad movable to make contact with said circuit board.

9. An electronic keyboard instrument as claimed in claim 8 wherein said fingerboard includes a cover with openings for each said key, and each said key includes a key cover member covering each said switch member.

10. For use with a music synthesizer having conventional MIDI input means:

an electronic keyboard instrument having a general shape of a guitar including a fingerboard elongated in a first direction and a body enclosing a chamber attached to said fingerboard;

said fingerboard including a plurality of keys arranged in rows and in columns along said fingerboard wherein the rows extend along the fingerboard in said first direction;

a circuit board in said fingerboard;

each said key including a conductive pad, means for mounting each said key independently movable of every other one of said keys and movable to bring said conductive pad in contact with said circuit board;

said circuit board including means for forming individual key input signals in response to said keys contacting said circuit board; and central processing means in said chamber connected to said circuit board for receiving said individual key input signals from said circuit board and for providing MIDI output signals to said music synthesizer.

11. An electronic musical instrument in accordance with claim 10 wherein said music synthesizer is incorporated in said instrument.

12. An electronic keyboard instrument in accordance with claim 10 wherein said fingerboard also includes pressure sensitive means responsive to movement of said keys for forming signals varying with the pressure on said keys and circuit means for connecting said pressure sensitive means to said central processing unit to vary signals produced thereby in response to sensed pressure applied to said keys.

13. An electronic keyboard instrument as claimed in claim 10 wherein said central processing means includes a memory, said memory stores codes for individual musical notes and said central processing means responds to individual said key input signals to select said codes for individual notes being supplied to said central processing means.

14. An electronic keyboard instrument as claimed in claim 10 wherein said keys are colored black and white with said keys representing notes A, B, C, D, E, F, and G of the chromatic scale being colored white and said keys representing other notes being colored black.

15. An electronic keyboard instrument as claimed in claim 10 wherein said fingerboard includes a cover with openings for each said key, and each said key includes a key cover member covering switch member.

16. An electronic keyboard instrument in accordance with claim 10 wherein said key input signals are representative of musical notes and said body includes an array of rubber pads operatively connected to said central processing unit which are pressed to alter dynamic characteristics of said musical notes such as pitch bending, volume and vibrato, and to trigger special musical sounds such as percussion.

17. For use with a synthesizer having MIDI input means:

an electronic musical keyboard instrument comprising a housing, a fingerboard elongated in a first direction carried on said housing;

a plurality of keys arranged in rows and columns along said fingerboard wherein the rows extend along said fingerboard in said first direction;

a circuit board within said fingerboard;

means for mounting each said key movable independently of every other one of said keys and movable into contact with said circuit board;

a central processing unit;

said circuit board including means for forming key input signals in response to said keys contacting said circuit board and for transmitting said signals to said central processing unit;

said central processing unit including means for scanning said circuit board and for receiving the key input signals from said forming and transmitting means and for outputting said key input signals in MIDI format.

18. An electronic keyboard instrument in accordance with claim 17 wherein said fingerboard includes pressure responsive means responsive to movement of said keys for forming signals varying with the pressure on said keys and circuit means connecting said pressure responsive means to said central processing unit.

19. An electronic keyboard instrument in accordance with claim 17 wherein a plurality of said keys of a single row of said rows are operable simultaneously to produce a corresponding plurality of said key input signals substantially simultaneously.

20. An electronic keyboard instrument as claimed in claim 17 wherein said central processing unit includes a memory, said memory stores codes for individual musical notes and said central processing unit responds to individual said key input signals to select codes for individual notes from said memory.

21. An electronic keyboard instrument as claimed in claim 20 wherein said central processing unit includes programmable means for programming said codes.

22. An electronic keyboard instrument as claimed in claim 21 wherein said programmable means includes switch means in said housing.

23. An electronic keyboard instrument as claimed in claim 22 wherein said housing includes a plurality of rubber pads operatively connected to said switch means to alter dynamic characteristics of said notes such as pitchbending and vibrato.

24. An electronic keyboard instrument as claimed in claim 22 wherein said switch means includes connections to selectively program said central processing unit to modify said codes for said key input signals originating in different areas of said fingerboard.

25. An electronic musical instrument in accordance with claim 1 wherein said keys are color coded to identify at least one of the twelve tones of the chromatic scale with a color different from others of said keys.

* * * * *